US010472738B2

(12) United States Patent
Arai et al.

(10) Patent No.: US 10,472,738 B2
(45) Date of Patent: Nov. 12, 2019

(54) GAS SUPPLY BLOWOUT NOZZLE AND METHOD OF PRODUCING FLAME-PROOFED FIBER AND CARBON FIBER

(71) Applicant: MITSUBISHI RAYON CO., LTD., Chiyoda-ku (JP)

(72) Inventors: Risa Arai, Otake (JP); Satoshi Kaji, Otake (JP); Atsushi Kawamura, Otake (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 721 days.

(21) Appl. No.: 14/907,001

(22) PCT Filed: Jul. 23, 2014

(86) PCT No.: PCT/JP2014/069454
§ 371 (c)(1),
(2) Date: Jan. 22, 2016

(87) PCT Pub. No.: WO2015/012311
PCT Pub. Date: Jan. 29, 2015

(65) Prior Publication Data

US 2016/0160395 A1 Jun. 9, 2016

(30) Foreign Application Priority Data

Jul. 23, 2013 (JP) ..... 2013-152407

(51) Int. Cl.
*D01F 9/32* (2006.01)
*B05B 1/14* (2006.01)
(Continued)

(52) U.S. Cl.
CPC ..... *D01F 9/32* (2013.01); *B05B 1/14* (2013.01); *B05B 1/3402* (2018.08); *D01D 10/02* (2013.01);
(Continued)

(58) Field of Classification Search
CPC ..... D01F 9/32; B05B 1/34
(Continued)

(56) References Cited

U.S. PATENT DOCUMENTS 2,864,406 A * 12/1958 Schewel ..... F01N 13/20 239/505
5,890,958 A * 4/1999 Greiner ..... B60H 1/3414 454/155
(Continued)

FOREIGN PATENT DOCUMENTS

JP 58-208433 A 12/1983
JP 60-30762 B2 7/1985
(Continued)

OTHER PUBLICATIONS

International Search Report dated Oct. 21, 2014 for PCT/JP2014/069454 filed on Jul. 23, 2014.
(Continued)

*Primary Examiner* — Alison L Hindenlang
*Assistant Examiner* — George W. Brady
(74) *Attorney, Agent, or Firm* — Oblon, McClelland, Maier & Neustadt, L.L.P.

(57) ABSTRACT

A method for producing a flame-proofed fiber by performing a flame-proofing treatment on a carbon-fiber precursor fiber bundle with a heat treatment furnace including a gas supply blowout nozzle, including:

a nozzle body including an inclined plate that guides a gas flowing straightly from a gas inlet port to a rectification board; and (Continued)

the rectification board which rectifies the flow of the gas to blow out toward a yarn from a gas outlet port, where a gas introduction direction in the nozzle is different from a gas blowing out direction, a gas guiding zone is between the inclined plate and the rectification board and includes a guide plate in a space between the gas inlet port and the rectification board and divides the gas supplied from the inlet port into two or more streams, and at least one of between the inclined plate and the guide plate or between the guide plates, an upstream passage width W1 perpendicular to a gas flowing direction inside the gas passage and any downstream passage width W2 satisfy W1≥W2.

17 Claims, 4 Drawing Sheets

(51) Int. Cl.

| | |
|---|---|
| ***F27B 9/28*** | (2006.01) |
| ***D01D 10/02*** | (2006.01) |
| ***F26B 21/00*** | (2006.01) |
| ***D02J 13/00*** | (2006.01) |
| ***B05B 1/34*** | (2006.01) |
| ***D01F 9/22*** | (2006.01) |

(52) U.S. Cl.
CPC ..... *D01F 9/22* (2013.01); *D02J 13/00* (2013.01); *F26B 21/004* (2013.01); *F27B 9/28* (2013.01); *B05B 1/34* (2013.01); *D10B 2101/12* (2013.01)

(58) Field of Classification Search
USPC ..... 239/502, 590.5, 592, 593
See application file for complete search history.

(56) References Cited

U.S. PATENT DOCUMENTS

| | | | | |
|---|---|---|---|---|
| 8,739,752 | B2 * | 6/2014 | Honzawa | F02M 35/10013 123/184.21 |
| 2008/0118427 | A1 * | 5/2008 | Leon y Leon | D01F 9/225 423/447.2 |
| 2013/0167397 | A1 * | 7/2013 | Bagwell | F26B 3/04 34/223 |
| 2014/0161711 | A1 | 6/2014 | Kaji et al. | |
| 2014/0216259 | A1 * | 8/2014 | Iwaki | F24F 3/166 96/19 |
| 2015/0228459 | A1 * | 8/2015 | Matsumoto | H01J 37/32449 438/714 |
| 2015/0360233 | A1 * | 12/2015 | Vanella | B03C 3/08 96/54 |
| 2018/0238622 | A1 * | 8/2018 | Wieland | F26B 15/14 |

FOREIGN PATENT DOCUMENTS

| | | | |
|---|---|---|---|
| JP | 07-008844 | A | 1/1995 |
| JP | 2000-88464 | A | 3/2000 |
| JP | 2001-316946 | A | 11/2001 |
| JP | 2002-115125 | A | 4/2002 |
| JP | 2002-194627 | A | 7/2002 |
| JP | 2007-247130 | A | 9/2007 |
| KR | 10-1229347 | B1 | 2/2013 |
| WO | 2013/015343 | A1 | 1/2013 |

OTHER PUBLICATIONS

Extended European Search Report dated Jun. 30, 2016 in Patent Application No. 14828841.8.

* cited by examiner

GAS SUPPLY BLOWOUT NOZZLE AND METHOD OF PRODUCING FLAME-PROOFED FIBER AND CARBON FIBER

TECHNICAL FIELD

The present invention relates to a gas supply blowout nozzle capable of changing a gas blowing direction and a method of producing a flame-proofed fiber and a carbon fiber using the gas supply blowout nozzle.

BACKGROUND ART

Generally, a polyacrylonitrile based carbon fiber is obtained by a flame-proofing treatment at 200° C. or more in an oxidizing atmosphere and a carbonizing treatment at 300° C. or more in an inert atmosphere. In a flame-proofing step, a flame-proofing reaction is started when the temperature of a precursor fiber bundle is increased by hot air. Further, the flame-proofing reaction is controlled by removing the reaction heat of the flame-proofing reaction. Here, when the wind speed or the temperature in the hot air is not uniform, the flame-proofing reaction would not be uniform, and hence troubles such as smoke or breakage of fibers occurs. Further, the quality of the product is not uniform. Therefore, there is a need to remove unevenness in flame-proofing step by performing a flame-proofing treatment in a uniform condition, and thus to attain a uniform property of an obtained continuous fiber bundle and improving production efficiency.

In the related art, a heat treatment furnace, especially, a heat treatment furnace used to produce a carbon fiber includes a blowout nozzle which blows hot air into a heat treatment chamber supplied from a circulation fan. Here, it is desirable that the velocity of the hot air supplied from the blowout nozzle into the heat treatment chamber be uniform. For example, JP 58-208433 A (Patent Document 1) discloses a blowout nozzle in which a hot air blowing surface is provided so that hot air blows along a traveling yarn, a direction changing guide vane is provided in the hot air blowing surface so as to direct the hot air, and a metal mesh or a porous plate as a flow conditioner (rectifier) is disposed at one of the front and rear sides of the direction changing guide vane or both front and rear sides thereof. According to this method, when the average wind speed of the heat treatment chamber is 2 m/s, the variation can be adjusted within 1.5 to 2.5 m/s.

Further, JP 2002-194627 A (Patent Document 2) discloses a blowout nozzle having a uniform wind speed distribution in the width direction of a nozzle blowout port as below. The inside of the blowout nozzle is defined as an introduction zone and a flow rectification zone, and the introduction zone is provided with a guide vane that decreases bending loss in a passage. In the flow rectification zone, porous plates are inserted into the nozzle in the direction substantially perpendicular to the hot air flowing direction and a space is formed at the downstream side of the each porous plate. Accordingly, it is possible to exhibit an effect of decreasing the unevenness of wind speed of the hot air. Further, the flow of the hot air is rectified in a direction perpendicular to the nozzle blowout port by a plurality of rectification plates provided right before the blowout port of the nozzle. In order to make the difference $\Delta V$ between the maximum wind speed and a minimum wind speed in the width direction of the nozzle blowout port be within Vm, the number of stages of the flow rectification zone is set so as to fix the pressure loss of the flow rectification zone by setting the number N of the stages of the flow rectification zone provided inside the nozzle to be ½ or more of $\lambda/Vm$ based on a coefficient $\lambda$. Accordingly, the wind speed is controlled within the range of 2.9 to 3.2 m/s with respect to the average wind speed of 3 m/s of the treatment chamber.

CITATION LIST

Patent Document

Patent Document 1: JP 58-208433 A
Patent Document 2: JP 2002-194627 A

DISCLOSURE OF THE INVENTION

Problem to be Solved by the Invention

In Patent Document 1, the porous plate or the metal mesh which is provided to straighten the flow of the hot air for the uniform wind speed thereof inside the treatment chamber causes pressure loss due to the passage of the hot air. As a result, a problem arises in the power load of the blowing fan. Further, in Patent Document 2, the porous plate is blocked by suspended solid materials in the hot air. Thus, there is a possibility that the wind speed of the hot air is not uniform resulting in the troubles. For that reason, there is a need to periodically clean the porous plate in order to prevent the blockage thereof. The length of a continuous production is limited by the needs for the cleaning operation.

Therefore, an objective of the present invention is to provide a gas supply blowout nozzle capable of improving production efficiency, decreasing running cost while enabling a stable operation for a long period of time, and obtaining a uniform property of a fiber bundle subjected to a heat treatment by removing unevenness in flame-proofing step during a heat treatment through a uniform atmosphere inside a heat treatment chamber for the continuous fiber bundle and particularly suitable for a hot air circulation type convection heating furnace, and is to provide a method of producing a flame-proofed fiber and a carbon fiber by using a flame-proofing furnace with the same nozzle.

Means for Solving Problem

A gas supply blowout nozzle of the present invention is a gas supply blowout nozzle in which a gas introduction direction is different from a gas blowing out direction, and the gas supply blowout nozzle comprises a nozzle body which includes an inclined plate guiding a gas flowing straightly from a gas inlet port to a rectification board and the rectification board which rectifies the gas guided by the inclined plate so that the gas blows toward a yarn. The gas supply blowout nozzle includes a gas guiding zone in a space between the inclined plate and the rectification board, and the gas guiding zone includes one or more guide plates which divide the gas supplied from the gas inlet port of the gas supply blowout nozzle into two or more streams so that the gas is guided to the rectification board. In each gas passage formed at least one of between the inclined plate and the guide plate or between the guide plates, an upstream passage width W1 perpendicular to a gas flowing direction inside the gas passage and any downstream passage width W2 thereof satisfy the relation of $W1 \geq W2$.

Further, a gas supply blowout nozzle of the present invention is a gas supply blowout nozzle in which a gas introduction direction is different from a gas blowing out direction, and the gas supply blowout nozzle comprises a nozzle body which includes a guide plate guiding a gas flowing straightly from a gas inlet port to a rectification board and the rectification board which rectifies the gas guided by the guide plate so that the gas blows toward a yarn. The gas supply blowout nozzle includes a gas guiding zone which is formed in a space between the gas inlet port and the rectification board, and the gas guiding zone includes one or more guide plates which divide the gas supplied from the gas inlet port of the gas supply blowout nozzle into two or more streams so that the gas is guided to to the rectification board. In each gas passage formed at least one of between an inclined plate and the guide plate or between the guide plates, an upstream passage width W1 perpendicular to a gas flowing direction inside the gas passage and any downstream passage width W2 thereof satisfy the relation of W1≥W2.

According to a preferred aspect of the gas supply blowout nozzle of the present invention, it is desirable that the rectification board be directly attached to the nozzle body and the opening area A of the gas inlet port and the opening area B of a gas inlet of the rectification board satisfy the relation of A≤B. Further, in the gas guiding zone, the inclined plate and one of the guide plates can be disposed in parallel, and the guide plates can be disposed in parallel.

Further, the gas rectified with the rectification board may blow from the rectification board parallel to or perpendicular to the yarn traveling direction.

According to a preferred aspect of the present invention, it is desirable that the gas guiding zone of the gas supply blowout nozzle be formed in a tapered shape from the hot air inlet port to the opposite side surface by the inclined plate, and that the gas guiding zone include one or more guide plates separately guiding the gas passage toward the rectification board.

In the gas supply blowout nozzle of the present invention, it is desirable that a plurality of straightening plates be disposed in the rectification board so as to be parallel to the gas blowing direction, and that the relation of L/P≥4.0 and the relation of t/P≤0.2 be satisfied, wherein P indicates the pitch between the straightening plates, L indicates the length of the straightening plate, and t indicates the plate thickness of each straightening plate.

In the gas supply blowout nozzle of the present invention, it is desirable that one or more guide plates be disposed inside the gas guiding zone so as to guide the gas flowing from the gas inlet port toward the gas inlet of the rectification board and the distance to the upstream end of the guide plate adjacent to the inclined plate from the inclined plate and each distance between the upstream ends of the guide plates adjacent with each other be smaller than 580 mm. Further, the arrangement angle of one of the guide plates with respect to the gas flowing direction from the gas inlet port may be changed.

In the gas supply blowout nozzle of the present invention, it is desirable that the gas inlet of the rectification board be disposed inside the nozzle body and the length of the straightening plates in a portion of the rectification board near the gas inlet port of the nozzle body be made shorter than the length of the straightening plates in the other portion of the rectification board by shortening the straightening plates on the side of the gas inlet of the rectification board. Further, the length of the straightening plate is sequentially shortened toward the gas inlet port so that a tapered portion of the rectification board is formed.

In the gas supply blowout nozzle of the present invention, it is desirable that a stream separation plate be provided near the gas outlet port in the gas inlet port and on a side surface of the nozzle body near the rectification board and the stream separation plate can extend toward the upstream side in the yarn traveling direction, and that the area Sh of the stream separation plate projected toward the gas inlet port be 1/10 or less and 1/50 or more of the opening area Si of the gas inlet port. Further, an end straight portion which guides a gas stream to between the straightening plates may be provided in the narrow end of the nozzle body having a substantially right angled triangle in the top view. In this case, it is desirable that the length x of the end straight portion and the width W0 of the gas inlet port satisfy the relation of x/W0≤0.06.

A method for producing a flame-proofed fiber of the present invention is a method for producing a flame-proofed fiber comprising performing a heat treatment on a carbon-fiber precursor fiber bundle by using a heat treatment furnace in which hot air is supplied into a heat treatment chamber from a gas supply blowout nozzle in which a gas introduction direction is different from a gas blowing out direction. The gas supply blowout nozzle comprises a nozzle body which includes an inclined plate guiding a gas flowing straightly through a gas inlet port toward a rectification board and the rectification board which rectifies the flow of the gas guided by the inclined plate so that the gas blows out in parallel to the yarn traveling direction. A gas guiding zone is formed in a space between the inclined plate and the rectification board, and the gas guiding zone is provided with one or more guide plates so that each of the passage width perpendicular to the gas stream is not widened toward the downstream side.

In the method for producing a carbon fiber of the present invention, a carbon fiber is produced by performing a heat treatment on a carbon-fiber precursor fiber bundle using a blowout nozzle in which the difference in pressure between the gas immediately before introduced and immediately after blown out is set to be 160 Pa or less and the non-uniformity in the wind speed of the gas obtained by the method described below is 35% or less.

It is desirable that the volume of the gas supplied to the gas inlet port of the gas supply blowout nozzle be equal to or larger than 36 $m^3$/min and equal to or smaller than 115 $m^3$/min.

Here, the non-uniformity in the wind speed is obtained by the following method.

(Method for Obtaining Non-uniformity in Wind Speed)

The wind speed is measured at five points in a direction perpendicular to the yarn traveling direction on the downstream of 2 m from an end surface of the gas outlet port of the gas supply blowout nozzle, and the non-uniformity in the wind speed is calculated from the following formula (5). At the same time, the wind speed can be measured at five points of an end surface of the gas inlet port of the blowout nozzle and an end surface of the gas outlet port of the blowout nozzle, and an average value thereof can be calculated $$\text{non-uniformity in the wind speed}=\{(\text{maximum value}-\text{minimum value})\text{ of the wind speed}\times 100\}/\{(\text{average of wind speed at five positions})\times 2\} \quad (5)$$

In the method for producing a carbon fiber of the present invention, a carbon-fiber precursor fiber bundle widen into a sheet shape is introduced into a flame-proofing furnace, hot air blown from a gas supply blowout nozzle is blown toward the carbon-fiber precursor fiber bundle horizontally traveling through the flame-proofing furnace so as to perform a flame-proofing treatment thereon in the temperature range of 200° C. to 300° C., and the flame-proofed fiber obtained by the flame-proofing treatment is introduced into a carbonizing furnace so as to perform a carbonizing treatment thereon in the temperature range of 500° C. to 2500° C., thereby producing a carbon fiber. The flame-proofing treatment is performed by blowing the hot air blown out from the gas supply blowout nozzle toward the carbon-fiber precursor fiber bundle horizontally traveling through the flame-proofing furnace.

Effect of the Invention

Since the gas supply blowout nozzle of the heat treatment furnace of the invention employs the above-described configuration, it is possible to suppress resistance generated when a necessary volume of a gas is blown into the heat treatment furnace and hence to decrease the power load of the blowing fan.

Further, when the flame-proofed fiber and the carbon fiber are produced according to the above-described production method, it is possible to decrease the running cost of the blowing fan necessary for the heat treatment furnace and hence it is possible to provide the low-cost carbon fiber.

Further, since the porous plate is not used inside the gas passage in the gas supply blowout nozzle of the present invention, blockage of the porous plate of the blowout nozzle by suspended solid materials in the atmosphere does not occur. For that reason, it is possible to solve the non-uniformity in the quality of the product caused by degradation in wind speed distribution of the gas supplied into the heat treatment furnace caused by the blockage of the porous plate in production. Further, since there is no need to clean the porous plate, the burden of a worker decreases and the production can be continuously performed for a long period of times. Accordingly, it is possible to realize a stable production and to improve production efficiency.

MODE(S) FOR CARRYING OUT THE INVENTION

Hereinafter, a representative embodiment of the present invention will be described in detail with reference to the drawings.

Figure 1:
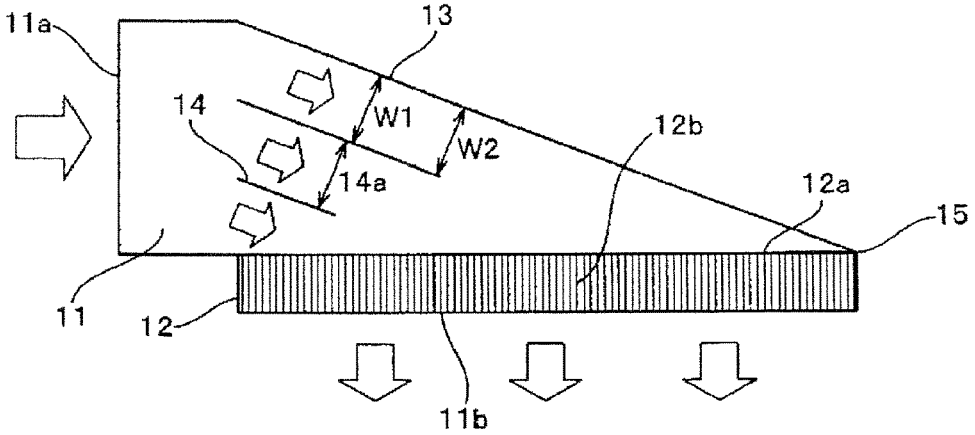
FIG. 1 is a schematic diagram illustrating a gas supply blowout nozzle according to a representative embodiment of the present invention.

FIG. 1 is a schematic top view illustrating a gas supply blowout nozzle 11 of an embodiment.

Here, a gas is supplied from a fan to a gas inlet port 11*a* so that the gas uniformly flows.

A gas supply blowout nozzle 11 of the present invention includes a nozzle body which has an inclined plate 13 guiding a gas straightly flowing from the gas inlet port 11*a* toward a rectification board and the rectification board 12 which is provided in the nozzle body so as to rectify (straighten) the flow of the gas guided by the inclined plate 13 and to blow the gas toward the yarn. Here, the gas introduction direction and the gas blowing out direction are different from each other.

In the gas supply blowout nozzle 11 of the present invention, the passage width is narrowed by the inclined plate 13 as the nozzle advances in the gas advancing direction, and hence the gas flowing straightly from the gas inlet port 11*a* can be directed toward a gas inlet 12*a* of the rectification board 12 while the advancing direction is changed. Here, a surface opposite to the gas inlet port 11*a* in the nozzle will be defined as an end portion 15. The inclined plate 13 is disposed on a surface opposite to the gas inlet 12*a* from the gas inlet port 11*a* to the end portion 15.

One or more guide plates 14 which guide a gas to the gas inlet 12*a* of the rectification board while changing the gas advancing direction are provided inside the nozzle similarly to the inclined plate 13. The gas which is supplied from the gas inlet port 11*a* is divided into two or more streams in the vicinity of the gas inlet port 11*a* by the guide plates 14 and the inclined plate 13, and is guided to the gas inlet 12*a* of the rectification board 12. In the gas passage formed by the inclined plate 13 and the guide plate 14 and the gas passages formed by the guide plates 14, the installation position or the arrangement angle of the guide plates 14 is set so that the passage width 14*a* perpendicular to the stream is not widened in a direction from the upstream side toward the downstream side, and hence the drift inside the gas passage can be prevented. It is desirable to dispose the guide plates 14 so that the inclined plate 13 and one of the guide plates 14 are disposed in parallel and the guide plates 14 are disposed in parallel from the viewpoint of further suppressing the non-uniformity in the wind speed and the pressure loss.

Further, when an opening area A of the gas inlet port 11*a* and an opening area B of the gas inlet 12*a* of the rectification board are set so as to satisfy the relation of $A \leq B$, an increase in pressure loss can be suppressed. Further, when the opening area B of the gas inlet 12*a* of the rectification board and an opening area C of a gas outlet port 11*b* are set to be equal to each other, the pressure loss can be suppressed in the same way.

When a plurality of straightening plates 12*b* are disposed in the gas outlet port 11*b*, the gas is rectified (straightened) so that the gas blowing direction is orthogonal to the gas outlet port 11*b* and hence the gas can be blown to the yarn traveling through the heat treatment chamber. The condition in which the rectification board 12 is disposed inside the heat treatment chamber is not particularly limited. However, the rectification board 12 can be disposed inside the heat treatment chamber so that the gas is blown in a direction parallel to or perpendicular to the yarn traveling through the heat treatment chamber.

In the straightening plate 12*b*, L/P of the straightening plate 12*b* is set to 4.0 or more, wherein the length in the gas passage length direction is indicated by L and the pitch of the straightening plate 12*b* is indicated by P. In the case of 4.0 or more, straightness is given to the stream when the gas is blown in a blocked space, and hence a straight stream is generated in the chamber 16 without any inclined stream. It is further desirable that L/P be 6.0 or more. Further, in a flame-proofed fiber production apparatus, a yarn passes in the spaces in upper and lower directions of the straightening plates 12*b*, and during the passing a non-wind space is formed For this reason, it is desirable that L be 300 mm or less from the viewpoint of the control of the reaction heat.

Further, when the plate thickness of each straightening plate is indicated by t, it is desirable to satisfy the relation of $t/P \leq 0.2$ so that the ratio occupied by the thickness of the straitening plates in the blowing width becomes 20% or less. Here, when the pitch P of the straightening plate 12*b* is narrowed, the number of the straightening plates 12*b* increases, and hence the opening area of the gas outlet port 11*b* is decreased by the plate thickness. From the viewpoint of decreasing pressure loss, it is desirable that the opening area be 80% or more. It is further desirable that the relation of $t/P \leq 0.05$ be satisfied.

By placing the guide plate 14 on a line connecting points dividing a distance from a start end position of the inclined plate 13 to an opposite wall in the passage width direction to points dividing the width of gas inlet 12*a* of the rectification board 12 in the same manner, the volume of the gas flowing into an area defined by two of the guide plates 14 adjacent to each other is maintained and the gas is caused to flow out from the gas outlet port 11*b* while the angle is changed. Here, it is desirable to position the start points of the guide plates 14 aligned on the plane connecting the start end position of the inclined plate 13 to the opposite wall in the passage width direction. Accordingly, a gas of the above-described volume can be blown from the gas inlet. Further, when the guide plate 14 is provided so that the gap between the inclined plate 13 and the guide plate 14 adjacent thereto and the gap between the guide plates adjacent to each other become smaller than 580 mm, the stream in the passage can be controlled at the same direction thereof.

Further, the angle of the guide plate 14 may be changed as long as the passage width is not enlarged as described above.

Regarding the rectification board 12, by shortening the straightening plates 12*b* near the gas inlet port 11*a* of the nozzle body in the length toward the outlet, wind can efficiently flow out from the end near the gas inlet port 11*a*. When a part of the straightening plates 12*b* are shortened, it is desirable to form a tapered portion which is tapered so as to be sequentially shortened toward the gas inlet port 11*a*. Here, the wind speed inside the heat treatment chamber of the outermost end near the gas inlet port can be changed by setting the taper angle of the tapered portion of the rectification board 12. Here, the gas inlet 12*a* of the rectification board may be provided inner compared to the side surface of the blowout port of the gas inlet port 11*a*.

In order for the wind to flow out from the end portion of the rectification board 12 near the gas inlet port, a stream separation plate 17 is provided on the side surface upstream in relation to the end surface of the rectification board 12, and the stream following the wall surface is separated so as to come back to the end portion of the rectification board 12. By selecting the installation position and the length of the stream separation plate 17, the degree of curving of the separated stream line can be adjusted. As for the length (hight), it is desirable that the area Sh of the stream separation plate 17 projected to the cross-section in the perpendicular direction of the stream separation plate 17 be 1/10 or less and 1/50 or more of the opening area Si of the gas inlet port 11*a*. More desirably, 1/15 or less and 1/40 or more are set. The shape of the separation plate 17 is desirably a flat plate, a triangular prism, or a column, but the invention is not limited thereto.

In the tapered nozzle, when the contact portion between the inclined plate 13 and the gas inlet 12*a* of the rectification board has an acute angle, the pressure in the narrow end increases. By providing an end straight portion 15*a* having a length of several millimeters to several tens millimeters between the end point of the inclined plate 13 and the gas inlet 12*a* of the rectification board, a decrease in wind speed of blown out near the narrow end can be suppressed. When the length of the end straight portion 15*a* is indicated by x and the width of the gas inlet port 11*a* is indicated by W0, it is desirable that the ratio satisfy $x/W0 \leq 0.06$.

When the carbon fiber is produced by using the gas supply blowout nozzle 11 of the present invention, a difference in pressure (pressure loss) between the gas immediately before introduced into the gas supply blowout nozzle 11 and immediately after the blown out is 160 Pa or less and the non-uniformity in the wind speed of the gas at the position of 2 m on the downstream from the end surface of the gas outlet port 11*b* is 35% or less. For this reason, it is possible to produce a carbon fiber having uniform quality at low cost.

That is, if the pressure loss is 160 Pa or less, the power load of the blowing fan is suppressed to be small, and hence the running cost can be decreased. The pressure loss is more desirably 100 Pa or less and is further desirably 50 Pa or less. If the 1 pressure loss is set to 160 Pa or less, it is desirable that the opening area A of the gas inlet port 11*a* and the opening area B of the gas inlet 12*a* of the rectification board 12 satisfy a relation of $A \leq B$.

Further, if the non-uniformity in the wind speed is 35% or less, it is possible to suppress unevenness in temperature distribution inside the heat treatment furnace, thus the quality of the carbon fiber as the product is not non-uniform. The non-uniformity in the wind speed is more desirably 25% or less and further desirably 10% or less.

The pressure loss generated when the gas passes through the gas supply blowout nozzle 11 and the non-uniformity in the wind speed of the gas blowing from the gas outlet port 11*b* are influenced by the volume of the gas introduced into the gas supply blowout nozzle 11. The volume of the gas supplied to the gas inlet port 11*a* is desirably equal to or larger than 36 $m^3$/min and equal to or smaller than 115 $m^3$/min. When the volume of the gas is 36 $m^3$/min or more, a sufficient heat can be supplied to the yarn traveling through the heat treatment chamber. Thus, when the volume is 115 $m^3$/min or less, the power load of the blowing fan caused by the pressure loss can be decreased.

As a method of controlling the pressure loss and the non-uniformity in the wind speed, a method of setting the opening area of the gas inlet port 11*a* and the gas inlet 12*a* of the rectification board to an appropriate value without using the porous plate in the blowout nozzle, a method of satisfying the shapes or the arrangements of the inclined plate 13 and the guide plates 14 in the above-described specific condition, and a method of providing the end straight portion 15*a* or the stream separation plate 17 in the blowout nozzle can be provided.

EXAMPLES

Hereinafter, the present invention will be described in detail by referring to examples. However, the present invention is not limited thereto. Further, FIGS. 3 to 5 are schematic diagrams illustrating the cross-sectional structures of the gas supply blowout nozzles of examples and comparative examples. Furthermore, as the reference numerals and the signs of the examples and the comparative examples, the reference numerals and the signs of the representative embodiment are used.

Here, a method of measuring the average wind speed and the non-uniformity in the wind speed is as below.

(Average Wind Speed Measurement)

At the downstream position of 2 m from the end surface of the gas outlet port 11*b* of the gas supply blowout nozzle, a hot wire anemometer (KANOMAX Anemometer 6162) was inserted from the lateral side of the chamber 16, and the wind speed was measured at five points in a direction perpendicular to the yarn traveling direction. As the wind speed, the instantaneous wind speed was read every 1 second during 20 seconds at each position of five points, and the average of the reading for twenty seconds was used as the wind speed. The average of the wind speed at five positions was referred to as the average wind speed.

(Calculation for Non-uniformity in the Wind Speed)

A value calculated by the following relation (5) is used as the non-uniformity in the wind speed.

$$\text{Non-uniformity in the wind speed}=\{(\text{maximum value}-\text{minimum value})\text{ of wind speed}\times 100\}/\{(\text{average value of wind speed of five positions})\times 2\} \quad (5)$$

Example 1

FIG. 3(*a*) illustrates the gas supply blowout nozzle 11 according to Example 1 of the present invention. Then, the specific dimension or the measurement result is shown in Table 1.

Three guide plates 14 and the straightening plate 12*b* having a uniform length were provided inside the tapered nozzle of which the width and the height of the gas inlet port 11*a* were respectively 750 mm and 155 mm and the width of the gas outlet port 11*b* was 2,000 mm. The guide plates 14 were provided on a line connecting a point dividing a distance from the start end position of the inclined plate 13 to the opposite wall in the passage width direction to a point dividing the gas inlet 12*a* of the rectification board in the same manner, and the passage width W1 perpendicular to the gas passages formed between the guide plates 14 and the gas passage formed by the inclined plate 13 and the guide plate 14 was uniform. As the rectification board 12, a plurality of plates having a length of 80 mm and a plate thickness of 1 mm were provided every 20 mm within the gas outlet port 11*b* having a width of 2,000 mm. Here, the ratio L/P between the length L of the straightening plate 12*b* in the length direction and the pitch P of the straightening plate 12*b* was 4.0, and the total area ratio t/P of the straightening plate thickness in the blowing width was 0.05.

Figure 2:
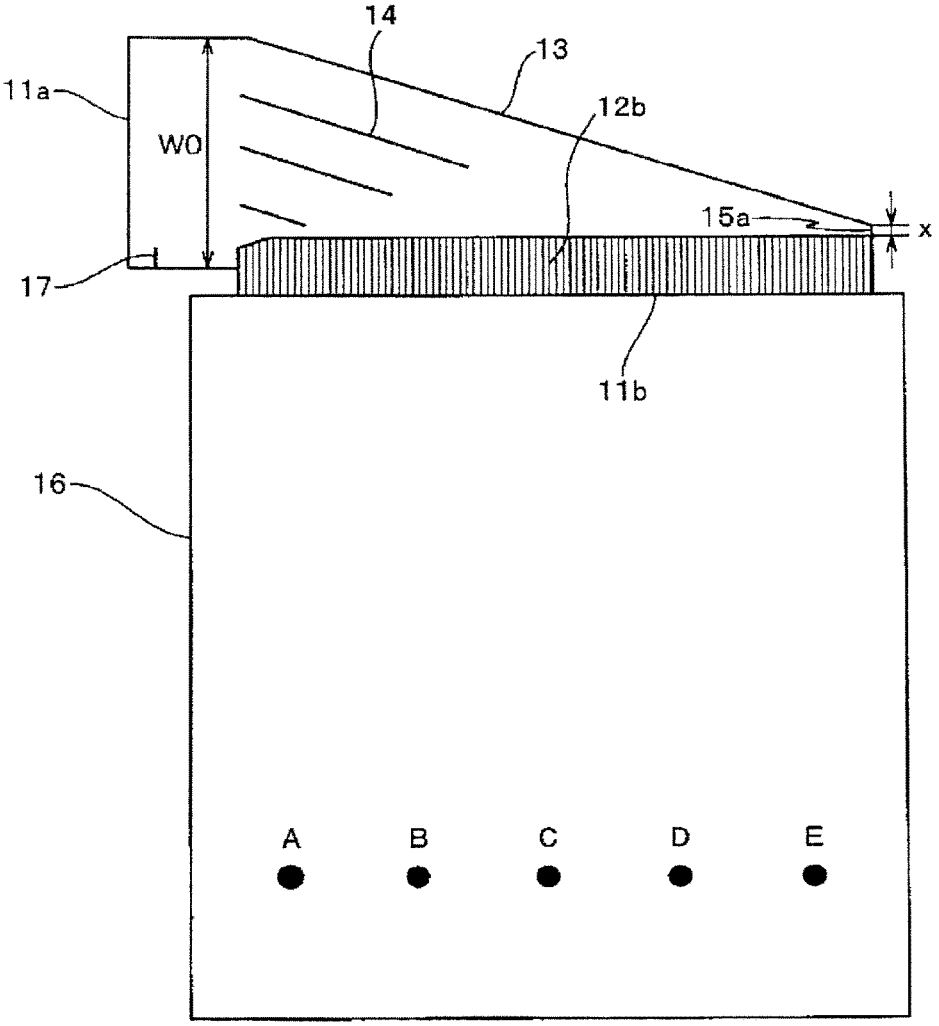
FIG. 2 is a schematic diagram illustrating a state where a chamber is connected to the gas supply blowout nozzle according to the embodiment.
Figure 3A:
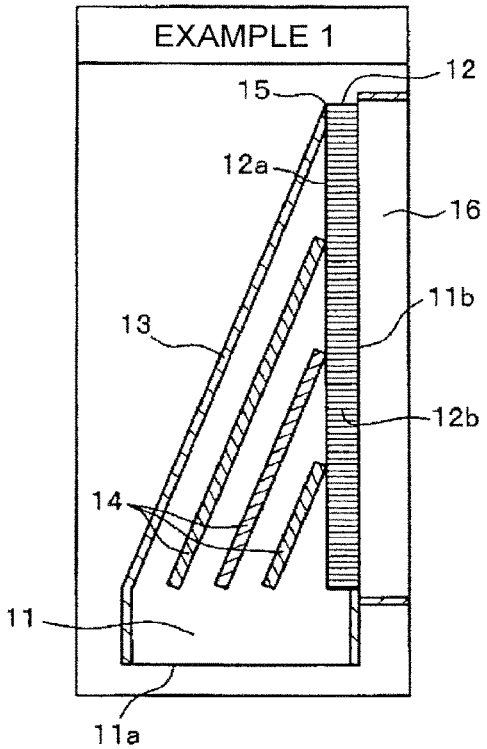
FIG. 3 is a schematic configuration diagram illustrating an example and comparative examples of the gas supply blowout nozzle of the present invention.
Figure 3B:
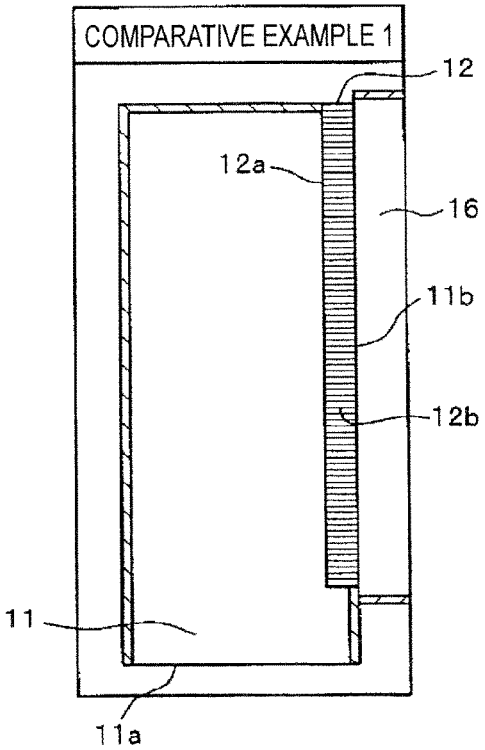
Figure 3C:
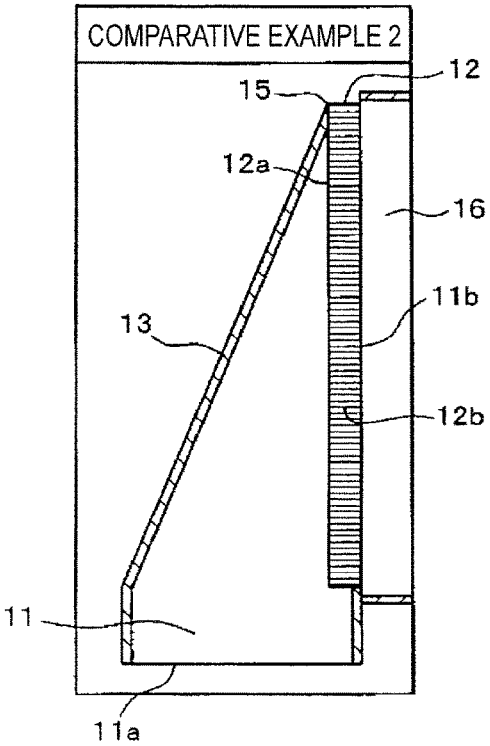
Figure 3D:
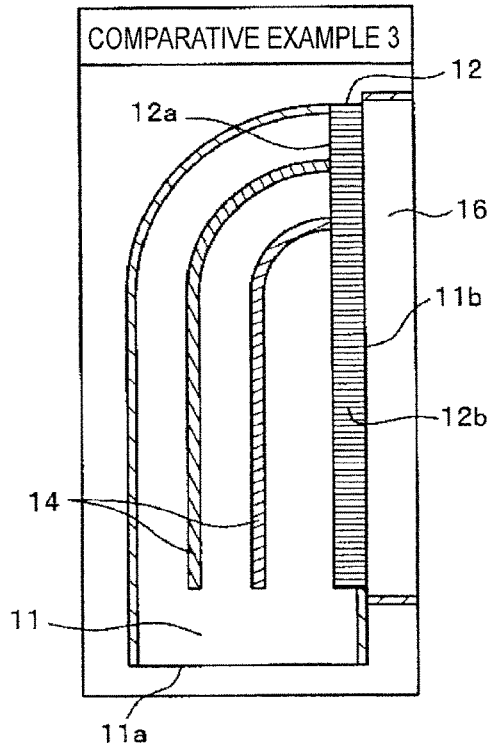
Figure 4A:
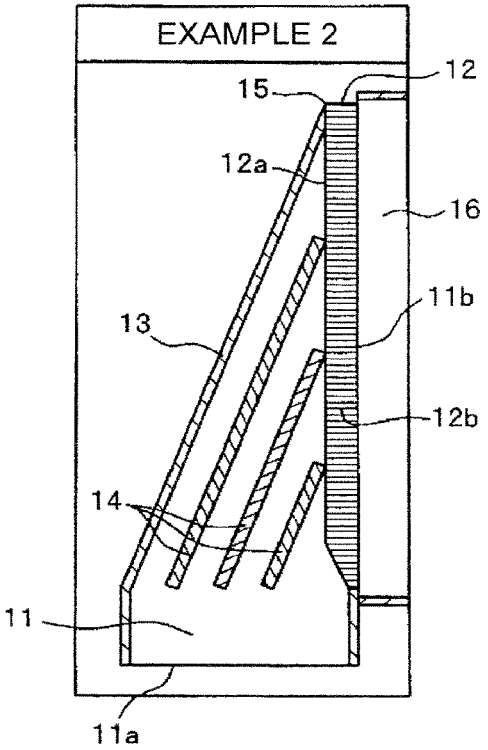
FIG. 4 is a schematic configuration diagram illustrating examples and a comparative example of the gas supply blowout nozzle of the present invention.
Figure 4B:
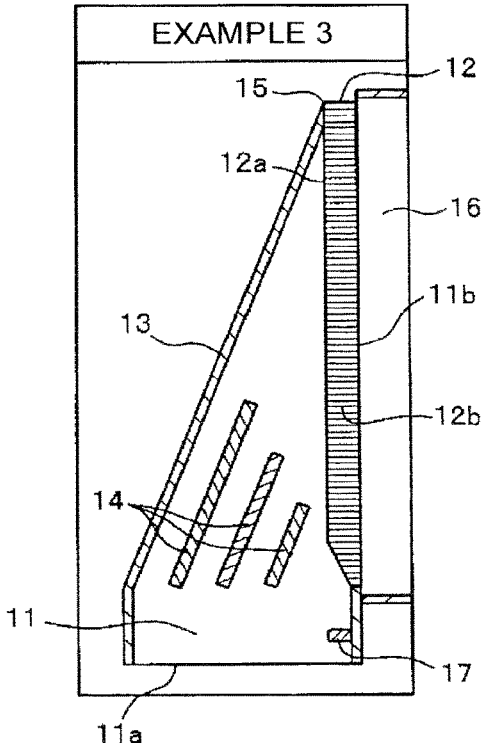
Figure 4C:
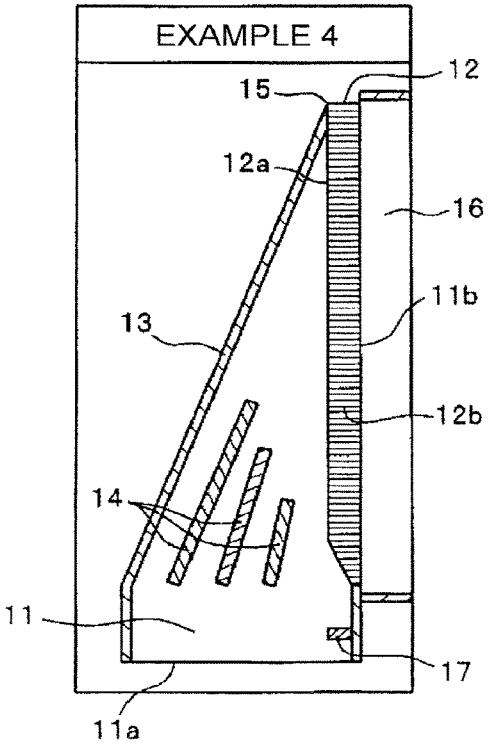
Figure 4D:
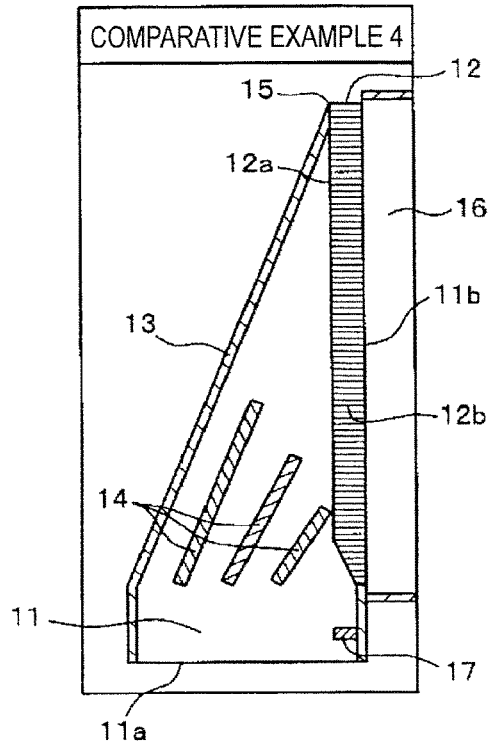
Figure 5A:
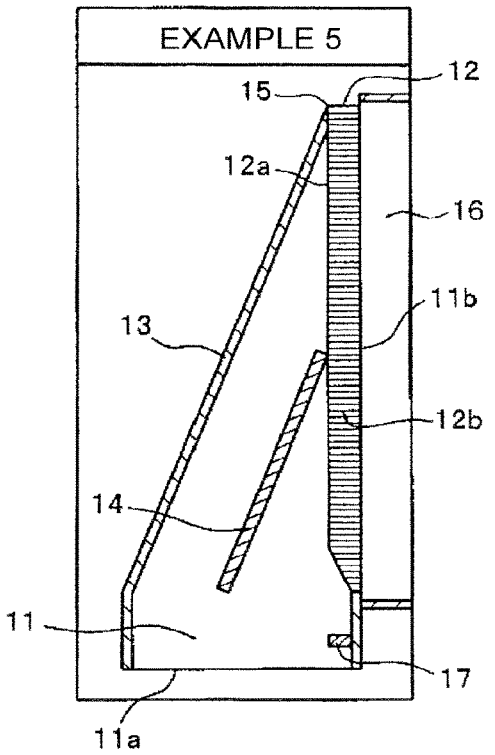
FIG. 5 is a schematic configuration diagram illustrating examples and a comparative example of the gas supply blowout nozzle of the present invention.
Figure 5B:
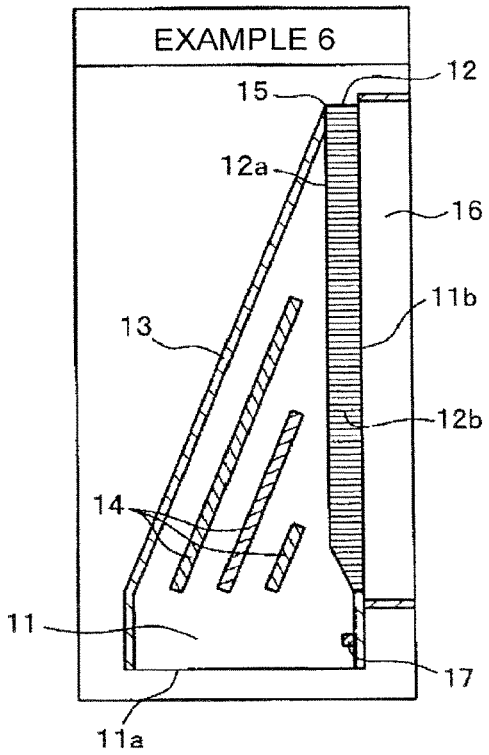
Figure 5C:
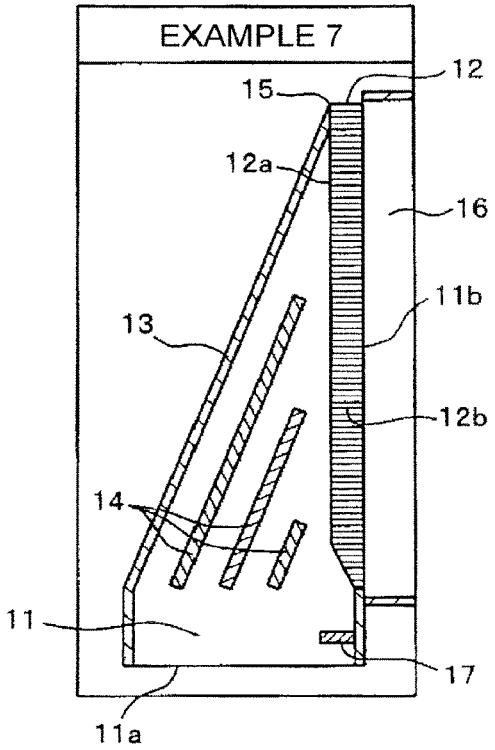
Figure 5D:
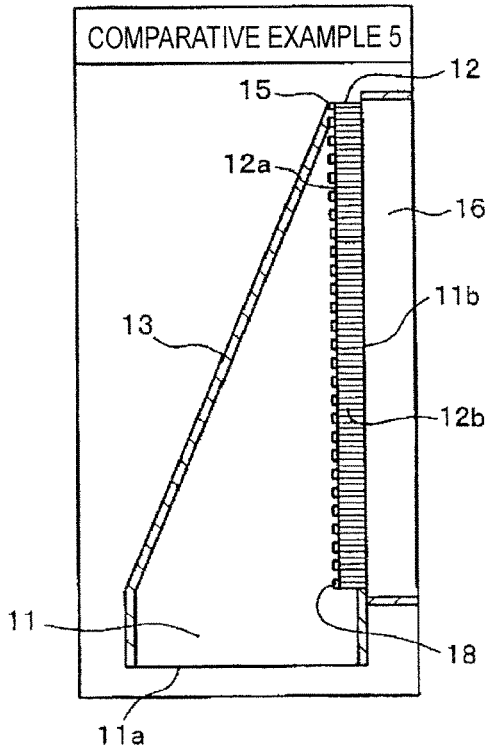

As shown in FIGS. 2 and 3(*a*), the chamber 16 having a width of 2,100 mm and a height of 225 mm was connected to the gas outlet port 11*b* of the gas supply blowout nozzle 11, and room-temperature air was supplied from a blowing fan (not shown) to the gas inlet port 11*a*. As a measurement result of the wind speed at five points(positions) in the width direction at the distance of 2 m from the gas outlet port 11*b* inside the chamber 16, the wind speed was 1.87 to 3.33 m/s, the average wind speed was 2.96 m/s, and the non-uniformity in the wind speed was ±25%. At this time, the pressure loss between the gas to flow into the body of the gas supply blowout nozzle 11 and the blown gas was 47 Pa.

Comparative Example 1

FIG. 3(*b*) illustrates the gas supply blowout nozzle 11 according to Comparative Example 1.

The straightening plates 12*b* having a uniform length were provided in the gas outlet port 11*b* of the rectangular nozzle body of which the width and the height of the gas inlet port 11*a* were respectively 750 mm and 155 mm and the width of the gas outlet port 11*b* was 2,000 mm, and room-temperature air was supplied into the nozzle body. At this time, as shown in Table 1, the wind speed value at five points inside the chamber 16 at the distance of 2 m from the gas outlet port 11*b* of the nozzle was 0.97 to 8.33 m/s, the average wind speed value was 2.77 m/s, and the non-uniformity in the wind speed was ±141%. Accordingly, a large variation occurred. At this time, the pressure loss between the gas to flow into the nozzle body and the blown gas was 39 Pa.

Comparative Example 2

FIG. 3(*c*) illustrates the gas supply blowout nozzle 11 according to Comparative Example 2.

The straightening plates 12*b* having a uniform length were provided in the gas outlet port 11*b* of the tapered nozzle body of which the width and the height of the gas inlet port 11*a* were respectively 750 mm and 155 mm and the width of the gas outlet port 11*b* was 2,000 mm and which was provided with the inclined plate 13, and room-temperature air was supplied into the nozzle body. The wind speed, the average wind speed, and the non-uniformity in the wind speed measured by the above-described measurement method were shown in Table 1.

Comparative Example 3

FIG. 3(*d*) illustrates the gas supply blowout nozzle 11 according to Comparative Example 3.

In the gas supply blowout nozzle 11 of which the width and the height of the gas inlet port 11*a* were respectively 750 mm and 155 mm and the width of the gas outlet port 11*b* was 2,000 mm, the corner opposite to the gas outlet port 11*b* of the front end was formed in a circular-arc shape having a radius of 670 mm, two circular-arc guide plates 14 were provided inside the nozzle, and the straightening plates 12*b* having a uniform length were provided in the gas outlet port 11*b*. Room-temperature air was supplied into the nozzle, and the wind speed, the average wind speed, and the non-uniformity in the wind speed measured by the above-described measurement method were shown in Table 1.

Example 2

FIG. 4(*a*) illustrates the gas supply blowout nozzle 11 according to Example 2 of the present invention.

Three guide plates 14 and the straightening plate 12*b* having a uniform length were provided inside the tapered nozzle body of which the width and the height of the gas inlet port 11*a* were respectively 750 mm and 155 mm and the width of the gas outlet port 11*b* was 2,000 mm. The position of the guide plate 14 was the same as Example 1. The straightening plates 12*b* originally having a length of 80 mm and a plate thickness of 1 mm were provided every 20 mm inside the gas outlet port 11*b* having a width of 2,000 mm. A portion of the rectification board—from the gas inlet port side end in the length of 100 mm was tapered so that the gas inlet 12*a* of the outermost end contacts the side surface of the nozzle body. Here, the ratio L/P between the length L of the length direction and the pitch P of the straightening plate was 4.0, and the total area ratio t/P of the straightening plate thickness in the blowing width was 0.05. Room-temperature air was supplied into the nozzle body, and the wind speed, the average wind speed, and the non-uniformity in the wind speed measured by the above-described measurement method were shown in Table 1.

Example 3

FIG. 4(*b*) illustrates the gas supply blowout nozzle 11 according to Example 3 of the present invention.

Three guide plates 14 dividing the passage into four parts, the flat plate-shaped stream separation plate 17 having a length of 40 mm, and the straightening plates 12*b* were provided inside the tapered nozzle of which the width and the height of the gas inlet port 11*a* were respectively 750 mm and 155 mm and the width of the gas outlet port 11*b* was 2,000 mm. Here, the area Sh of the stream separation plate 17 projected to the cross-section in the perpendicular direction of the stream separation plate 17 was 1/19 of the opening area Si of the gas inlet port 11*a*. The straightening plates 12*b* each having a length of 80 mm and a plate thickness of 1 mm were provided every 20 mm inside the gas outlet port 11*b* having a width of 2,000 mm. A taper is formed by changing the length of the straightening plate in the width of 100 mm near the gas inlet port. At this time, the ratio L/P between the length L of the length direction and the pitch P of the straightening plate 12*b* was 4.0, and the total area ratio t/P of the straightening plate thickness in the blowing width was 0.05. The narrow end of the nozzle was provided with the end straight portion, and the ratio x/W0 between the end straight portion length x and the gas inlet width W0 was 0.013.

The chamber 16 having a width of 2,100 mm and a height of 225 mm was connected to the gas outlet port 11*b* of the gas supply blowout nozzle 11, and room-temperature air was supplied from a blowing fan (not shown) to the gas inlet port 11*a*. The wind speed, the average wind speed, and the non-uniformity in the wind speed measured by the above-described measurement method were shown in Table 1.

Example 4

FIG. 4(*c*) illustrates the gas supply blowout nozzle 11 according to Example 4 of the present invention.

In the nozzle body of Example 3, the start point of the guide plate 14 was fixed, and room-temperature air was supplied from a blowing fan (not shown) to the gas inlet port 11*a*. By changing the angle of the guide plates 14, the passage width with respect to the stream were set as W1>W2. The wind speed, the average wind speed, and the non-uniformity in the wind speed measured by the above-described measurement method were shown in Table 1.

Comparative Example 4

FIG. 4(*d*) illustrates the gas supply blowout nozzle 11 according to Comparative Example 4.

In the nozzle body of Example 3, the start point of the guide plate 14 was fixed, and room-temperature air was supplied from a blowing fan (not shown) to the gas inlet port 11*a*. By changing the angle of the guide plates 14, the passage width with respect to the stream were set as W1<W2. The wind speed, the average wind speed, and the non-uniformity in the wind speed measured by the above-described measurement method were shown in Table 1.

Example 5

FIG. 5(*a*) illustrates the gas supply blowout nozzle 11 according to Example 5 of the present invention.

One guide plate 14 dividing the passage into two parts, the flat plate-shaped stream separation plate 17 having a length of 40 mm, and the straightening plates 12*a* were provided inside the tapered nozzle of which the width and the height of the gas inlet port 11*a* were respectively 1,080 mm and 155 mm and the width of the gas outlet port 11*b* was 2,000 mm. Here, the gap between the inclined plate 13 and the guide plate 14 was 500 mm. The area Sh of the separation plate 17 in the perpendicular direction of the separation plate 17 was 1/27 of the opening area Si of the gas inlet port 11*a*. The straightening plates 12*b* each having a length of 80 mm and a plate thickness of 1 mm were provided every 20 mm inside the gas outlet port 11*b* having a width of 2,000 mm. A taper is formed by sequentially changing the length of the straightening plate in the area of the width of 100 mm near the gas inlet port. At this time, the ratio L/P between the length L of the length direction and the pitch P of the straightening plate 12*b* was 4.0, and the total area ratio t/P of the straightening plate thickness in the blowing width was 0.05. The narrow end of the nozzle body was provided with the end straight portion 15*a*, and the ratio x/W0 between the end straight portion length x and the gas inlet width W0 was 0.013.

The chamber 16 having a width of 2,100 mm and a height of 225 mm was connected to the gas outlet port 11*b* of the gas supply blowout nozzle 11, and room-temperature air was supplied from a blowing fan (not shown) to the gas inlet port 11*a*. The wind speed, the average wind speed, and the non-uniformity in the wind speed measured by the above-described measurement method were shown in Table 1.

Example 6

FIG. 5(*b*) illustrates the gas supply blowout nozzle 11 according to Example 6 of the present invention.

Three guide plates 14 dividing the passage into four parts, the flat plate-shaped stream separation plate 17 having a length of 20 mm, and the straightening plates 12*b* were provided inside the tapered nozzle of which the width and the height of the gas inlet port 11*a* were respectively 750 mm and 155 mm and the width of the gas outlet port 11*b* was 2,000 mm. Here, the area Sh of the stream separation plate 17 projected to the cross-section in the perpendicular direction of the separation plate 17 was 1/38 of the opening area Si of the gas inlet port 11*a*. The straightening plates 12*b* each having a length of 80 mm and a plate thickness of 1 mm were provided every 20 mm inside the gas outlet port 11*b* having a width of 2,000 mm. A taper is formed by sequentially changing the length of the straightening plate in an area of the width of 100 mm near the gas inlet port. At this time, the ratio L/P between the length L of the length direction and the pitch P of the straightening plate was 4.0, and the total area ratio t/P of the straightening plate thickness in the blowing width was 0.05.

The chamber 16 having a width of 2,100 mm and a height of 225 mm was connected to the gas outlet port 11*b* of the gas supply blowout nozzle, and room-temperature air was supplied from a blowing fan (not shown) to the gas inlet port 11*a*. The wind speed, the average wind speed, and the non-uniformity in the wind speed measured by the above-described measurement method were shown in Table 1.

Example 7

FIG. 5(*c*) illustrates the gas supply blowout nozzle 11 according to Example 7 of the present invention.

Three guide plates 14 dividing the passage into four parts, the flat plate-shaped stream separation plate 17 having a length of 60 mm, and the straightening plates 12*b* were provided inside the tapered nozzle body of which the width w0 and the height of the gas inlet port 11*a* were respectively 750 mm and 155 mm and the width of the gas outlet port 11*b* was 2,000 mm. Here, the area Sh of the stream separation plate 17 projected to the cross-section in the perpendicular direction of the separation plate 17 was 1/13 of the opening area Si of the gas inlet port 11*a*. The straightening plates 12*b* each having a length of 80 mm and a plate thickness of 1 mm were provided every 20 mm inside the gas outlet port 11*b* having a width of 2,000 mm. A taper is formed by sequentially changing the length of the straightening plate in an area of the width of 100 mm near the gas inlet port. At this time, the ratio L/P between the length L of the length direction and the pitch P of the straightening plate 12*b* was 4.0, and the total area ratio t/P of the straightening plate thickness in the blowing width was 0.05.

The chamber 16 having a width of 2,100 mm and a height of 225 mm was connected to the gas outlet port 11*b* of the gas supply blowout nozzle 11, and room-temperature air was supplied from a blowing fan (not shown) to the gas inlet port 11*a*. The wind speed, the average wind speed, and the non-uniformity in the wind speed measured by the above-described measurement method were shown in Table 1.

Example 8

Example 8 is not shown in the drawings. Three guide plates dividing the passage into four parts, the flat plate-shaped stream separation plate having a length of 40 mm, and the straightening plates were provided inside the tapered nozzle of which the width and the height of the gas inlet port of the gas supply blowout nozzle were respectively 750 mm and 155 mm and the width of the gas outlet port was 2,000 mm. Here, the area Sh of the stream separation plate projected to the cross-section in the perpendicular direction of the separation plate was 1/19 of the opening area Si of the gas inlet port. The straightening plates each having a length of 160 mm and a plate thickness of 1 mm were provided every 20 mm inside the gas outlet port having a width of 2,000 mm. A taper is formed by sequentially changing the length of the straightening plate in an area of the width of 100 mm near the gas inlet port. At this time, the ratio L/P between the length L of the length direction and the pitch P of the straightening plate was 4.0, and the total area ratio t/P of the straightening plate thickness in the blowing width was 0.05. The narrow end of the nozzle was provided with the end straight portion, and the ratio x/W0 between the end straight portion length x and the gas inlet width W0 was 0.013.

The chamber having a width of 2,100 mm and a height of 225 mm was connected to the outlet of the gas supply blowout nozzle, and room-temperature air was supplied from the blowing fan to the gas inlet port. The wind speed, the average wind speed, and the non-uniformity in the wind speed measured by the above-described measurement method were shown in Table 1.

Comparative Example 5

FIG. 5(*d*) illustrates the gas supply blowout nozzle 11 according to Comparative Example 5 of the invention.

In the tapered nozzle of which the width W0 and the height of the gas inlet port 11*a* were respectively 750 mm and 155 mm and the width of the gas outlet port 11*b* was 2,000 mm, the above-described structure other than the rectification board 12 was not provided in the gas supply blowout nozzle 11, the porous plate 18 having an opening hole ratio of 15% and the rectification board 12 were sequentially provided in the flowing direction in the gas outlet port 11*b*, and room-temperature air was supplied from a blowing fan (not shown) to the gas inlet port 11*a*. The wind speed, the average wind speed, and the non-uniformity in the wind speed measured by the above-described measurement method were shown in Table 1. At this time, the pressure loss between the gas to flow into the gas supply blowout nozzle 11 and the blown gas was 620 Pa. Compared to Example 8, the pressure loss increased due to the porous plate 18.

Example 9

The gas supply blowout nozzle according to Example 9 of the present invention is not shown in the drawings.

This example was similar to Example 6 except that the amount of the air supplied from the blowing fan to the gas inlet port was changed. The wind speed, the average wind speed, and the non-uniformity in the wind speed measured by the above-described measurement method were shown in Table 1.

Example 10

The gas supply blowout nozzle according to Example 10 of the present invention is not shown in the drawings.

This example was similar to Example 6 except that the amount of the air supplied from the blowing fan to the gas inlet port was changed. The wind speed, the average wind speed, and the non-uniformity in the wind speed measured by the above-described measurement method were shown in Table 1.

TABLE 1

| | Example 1 | Comparative Example 1 | Comparative Example 2 | Comparative Example 3 | Example 2 | Example 3 | Example 4 | Comparative Example 4 |
|---|---|---|---|---|---|---|---|---|
| Width of gas inlet port: W0 (mm) | 750 | 750 | 750 | 750 | 750 | 750 | 750 | 750 |
| Nozzle height (mm) | 155 | 155 | 155 | 155 | 155 | 155 | 155 | 155 |
| Width of gas outlet port (mm) | 2000 | 2000 | 2000 | 2000 | 2000 | 2000 | 2000 | 2000 |
| Arrangement of guide plate | W1 constant | (No guide plate) | (No guide plate) | (Circular-arc guide plate) | W1 constant | W1 constant | W1 > W2 | W1 < W2 |
| Pitch between straightening plates: P (mm) | 20 | — | — | — | 20 | 20 | 20 | 20 |
| Length of straightening plate in length direction: L (mm) | 80 | — | — | — | 80 | 80 | 80 | 80 |

TABLE 1-continued

| | | | | | | | | |
|---|---|---|---|---|---|---|---|---|
| Plate thickness of straightening plate: t (mm) | 1.0 | — | — | — | 1.0 | 1.0 | 1.0 | 1.0 |
| L/P | 4.0 | — | — | — | 4.0 | 4.0 | 4.0 | 4.0 |
| t/P | 0.05 | — | — | — | 0.5 | 0.05 | 0.05 | 0.05 |
| Stream Separation plate | (Not provided) | (Not provided) | (Not provided) | (Not provided) | (Not provided) | 40 | 40 | 40 |
| Area ratio of stream separation plate to gas inlet port: Sh/Si | — | — | — | — | — | 1/19 | 1/19 | 1/19 |
| Length of the end straight portionx | — | — | — | — | — | 10 | 10 | 10 |
| x/W0 | — | — | — | — | — | 0.013 | 0.013 | 0.013 |
| Others | — | Rectangular nozzle | Tapered nozzle | Circular-arc nozzle | Attached obliquely to straightening plate | Attached obliquely to straightening plate | Attached obliquely to straightening plate | Attached obliquely to straightening plate |
| Wind speed (m/s) | 1.87 to 3.33 | 0.97 to 8.33 | 0.96 to 3.25 | 0.91 to 3.54 | 2.62 to 3.27 | 2.63 to 3.77 | 2.57 to 3.18 | 0.83 to 8.93 |
| Average wind speed (m/s) | 2.96 | 2.77 | 2.36 | 2.22 | 3.01 | 3.02 | 3.02 | 3.4 |
| Non-uniformity in the wind speed (%) | ±25 | ±141 | ±49 | ±59% | ±11 | ±19 | ±10 | ±122 |
| Pressure loss between gas to flow into gas supply blowout nozzle and blown gas (Pa) | 47 | 39 | 66 | 6 | 51 | 70 | 87 | 173 |

| | Example 5 | Example 6 | Example 7 | Example 8 | Comparative Example 5 | Example 9 | Example 10 |
|---|---|---|---|---|---|---|---|
| Width of gas inlet port: W0 (mm) | 750 | 750 | 750 | 750 | 750 | 750 | 750 |
| Nozzle height (mm) | 155 | 155 | 155 | 155 | 155 | 155 | 155 |
| Width of gas outlet port (mm) | 2000 | 2000 | 2000 | 2000 | 2000 | 2000 | 2000 |
| Arrangement of guide plate | W1 constant | W1 constant | W1 constant | W1 constant | (No guide plate) | W1 constant | W1 constant |
| Pitch between straightening plates: P (mm) | 20 | 20 | 20 | 20 | — | 20 | 20 |
| Length of straightening plate in length direction: L (mm) | 80 | 80 | 80 | 160 | — | 80 | 80 |
| Plate thickness of straightening plate: t (mm) | 1.0 | 1.0 | 1.0 | 1.0 | — | 1.0 | 1.0 |
| L/P | 4.0 | 4.0 | 4.0 | 8.0 | — | 4.0 | 4.0 |
| t/P | 0.05 | 0.05 | 0.05 | 0.05 | — | 0.05 | 0.05 |
| Stream Separation plate | 40 | 20 | 60 | 40 | (Not provided) | 20 | 20 |
| Area ratio of stream separation plate to gas inlet port: Sh/Si | 1/27 | 1/36 | 1/13 | 1/19 | — | 1/38 | 1/38 |
| Length of the end straight portionx | 14 | — | — | 10 | — | — | — |
| x/W0 | 0.013 | — | — | 0.013 | — | — | — |
| Others | Attached obliquely to straightening plate | Attached obliquely to straightening plate | Attached obliquely to straightening plate | Attached obliquely to straightening plate | Porous plate + straightening plate | Attached obliquely to straightening plate | Attached obliquely to straightening plate |
| Wind speed (m/s) | 2.29 to 3.93 | 2.95 to 3.25 | 2.85 to 5.13 | 2.82 to 3.22 | 1.65 to 3.25 | 2.00 to 2.50 | 3.90 to 5.40 |
| Average wind speed (m/s) | 3.03 | 3.08 | 3.44 | 2.94 | 2.63 | 2.26 | 4.56 |
| Non-uniformity in the wind speed (%) | ±27 | ±5.0 | ±33 | ±7.0 | ±30 | ±13 | ±16 |
| Pressure loss between gas to flow into gas supply blowout nozzle and blown gas (Pa) | 56 | 89 | 71 | 95 | 620 | 40 | 157 |

As described above, when a gas is supplied into the chamber by using the gas supply blowout nozzle of the present invention, it is possible to obtain a uniform wind speed inside the chamber and to further suppress the pressure loss caused by the passage through the nozzle. Particularly, when a flame-proofed fiber is produced by using a heat treatment furnace in which hot air is supplied from the gas supply blowout nozzle of the present invention into the heat treatment chamber, it is possible to obtain a uniform wind speed and a uniform temperature inside the heat treatment chamber. Further, it is possible to stabilize the process and to improve the quality of the product without causing a problem in which the porous plate is blocked by suspended solid materials inside the furnace.

EXPLANATIONS OF LETTERS OR NUMERALS

11: gas supply blowout nozzle
11*a:* gas inlet port
11*b:* gas outlet port
12: rectification board
12*a:* gas inlet of rectification board
12*b:* straightening plate
13: inclined plate
14: guide plate
14*a:* passage width perpendicular to stream
15: narrow end
15*a:* end straight portion
16: chamber
17: stream separation plate
18: porous plate

The invention claimed is:

1. A method for producing a flame-proofed fiber comprising performing a flame-proofing treatment on a carbon-fiber precursor fiber bundle by using a heat treatment furnace comprising a gas supply blowout nozzle, wherein the gas supply blowout nozzle comprises a nozzle body comprising an inclined plate adapted to guide a flow of a gas flowing from a gas inlet port directly in a straight line to a rectification board; and the rectification board which is adapted to rectify the flow of the gas guided by the inclined plate so that the gas blows out toward a yarn from a gas outlet port, wherein a gas introduction direction in the gas supply blowout nozzle is different from a gas blowing out direction, wherein a gas guiding zone is formed between the inclined plate and the rectification board, wherein the gas guiding zone comprises one or more guide plates which is disposed in a space between the gas inlet port and the rectification board and which divides the gas supplied from the gas inlet port of the gas supply blowout nozzle into two or more streams so that the gas is guided toward the rectification board, and wherein in each gas passage formed, at least one of between the inclined plate and the guide plate or between the guide plates, an upstream passage width W1 perpendicular to a gas flowing direction inside the gas passage and any downstream passage width W2 thereof satisfy the following relation $$W1 \geq W2 \quad (1).$$

2. The method according to claim 1, wherein the rectification board is directly attached to the nozzle body.

3. The method according to claim 1, wherein an opening area A of the gas inlet port and an opening area B of a gas inlet of the rectification board satisfy the relation of $A \leq B$.

4. The method according to claim 1, wherein in the gas guiding zone, the inclined plate and one of the guide plates are disposed in parallel, and the guide plates are disposed in parallel.

5. The method according to claim 1, wherein the rectification board is disposed so that the gas rectified with the rectification board blows parallel to a yarn traveling direction.

6. The method according to claim 1, wherein the rectification board is disposed so that the gas rectified with the rectification board blows in a direction perpendicular to a yarn traveling direction.

7. The method according to claim 1, wherein the gas guiding zone is formed in a tapered shape from the gas inlet port to an opposite side surface by the inclined plate, and the gas guiding zone comprises one or more guide plates separately guiding the gas passage toward the rectification board.

8. The method according to claim 1, wherein the one or more guide plates are disposed inside the gas guiding zone so as to guide the gas flowing from the gas inlet port toward a gas inlet of the rectification board, and wherein a distance to an upstream end of the guide plate adjacent to the inclined plate from the inclined plate, and each distance between upstream ends of the guide plates adjacent with each other are smaller than 580 mm.

9. The method according to claim 1, wherein an arrangement angle of one of the guide plates is changeable.

10. The method according to claim 1, further comprising:

a stream separation plate which is provided near the gas outlet port in the gas inlet port and on a side surface of the nozzle body near the rectification board, wherein an area Sh of the stream separation plate projected toward the gas inlet port is 1/10or less and 1/50or more of an opening area Si of the gas inlet port.

11. The method according to claim 1, wherein straightening plates are disposed in the rectification board so as to be parallel in the gas blowing direction, and the following relations (2) and (3) are satisfied $$L/P \geq 4.0 \quad (2)$$

$$t/P \leq 0.2 \quad (3)$$

wherein P indicates a pitch between the straightening plates, L indicates a length of each straightening plate, and t indicates a thickness of each straightening plate.

12. The method according to claim 11, wherein an end straight portion which guides a gas stream to between the straightening plates is provided in a narrow end of the nozzle body, and a length x of the end straight portion and a width W0 of the gas inlet port satisfy the following relation (4)

$$x/W0 \leq 0.06 \quad (4).$$

13. The method according to claim 11, wherein a gas inlet of the rectification board is disposed inside the nozzle body, and wherein a length of straightening plates in a portion of the rectification board near the gas inlet port of the nozzle body is made shorter than a length of straightening plates in the other portion of the rectification board by shortening the straightening plates on a side of the gas inlet of the rectification board.

14. The gas supply blowout nozzle according to claim 13, wherein the length of the straightening plates is sequentially shortened toward the gas inlet port so that a tapered portion of the rectification board is formed.

15. The method according to claim 1, wherein the method does not employ a porous plate.

16. A method for producing a carbon fiber, satisfying the following (a) to (c):

(a) introducing a carbon-fiber precursor fiber bundle widened into a sheet shape into a flame-proofing furnace comprising a gas supply blowout nozzle, so as to perform a flame-proofing treatment thereon in a temperature range of 200° C. to 300° C. and introducing a flame-proofed fiber obtained by the flame-proofing treatment into a carbonizing furnace so as to perform a carbonizing treatment thereon in a temperature range of 500° C. to 2500° C.;

(b) blowing hot air blown out from the gas supply blowout nozzle toward the carbon-fiber precursor fiber bundle horizontally traveling through the flame-proofing furnace; and (c) in the gas supply blowout nozzle, satisfying the following conditions i and ii:

i. a difference in pressure between the gas immediately before introduced into the gas supply blowout nozzle and the gas immediately after blown out from the gas supply blowout nozzle is 160 Pa or less; and ii. a non-uniformity in a wind speed of the gas blown out from the gas supply blowout nozzle is 35% or less, wherein the non-uniformity in the wind speed is obtained as follows:

the wind speed is measured at five points in a direction perpendicular to a yarn traveling direction downstream 2 m from an end surface of the gas outlet port of the gas supply blowout nozzle; and the non-uniformity in the wind speed is calculated by the following formula (5):

$$\text{non-uniformity in the wind speed}=\{(\text{maximum value}-\text{minimum value})\text{ of wind speed}\times 100\}/\{(\text{average value of wind speed at five positions})\times 2\} \quad (5),$$

further satisfying (d) to (f):

(d) in the gas supply blowout nozzle, satisfying the following conditions iii to vii:

iii. the gas supply blowout nozzle comprises a nozzle body and a rectification board, wherein the nozzle body comprises an inclined plate guiding the flow of the gas flowing from a gas inlet port directly in a straight line to the rectification board, and the rectification board is directly attached to the nozzle body so as to rectify the flow of the gas guided by the inclined plate and to blow the gas toward a yarn;

iv. a gas guiding zone is formed between the inclined plate and the rectification board and one or more guide plates are disposed in the gas guiding zone;

v. the passage width W1 perpendicular to the gas flowing direction inside a gas passage formed by the inclined plate and the guide plate and a gas passage formed between the guide plates and any downstream passage width W2 thereof satisfy the relation of $W1 \geq W2$;

vi. an opening area A of the gas inlet port and an opening area B of the rectification board satisfy the relation of $A \leq B$;

vii. a volumetric rate of the gas supplied to the gas inlet port is from 36 $m^3$/min to 115 $m^3$/min;

(e) dividing the gas supplied to the gas inlet port of the gas supply blowout nozzle into two or more streams by the one or more guide plates near the gas inlet port and guiding the gas to the rectification board by the inclined plate and the one or more guide plates; and (f) blowing the gas rectified by the rectification board from the gas outlet port in parallel to the yarn traveling direction.

17. The method according to claim 16, wherein in the gas guiding zone, the inclined plate and one of the guide plates are disposed in parallel and the guide plates are disposed in parallel.

* * * * *